US007128224B2

(12) United States Patent
Wilson, Jr.

(10) Patent No.: US 7,128,224 B2
(45) Date of Patent: Oct. 31, 2006

(54) APPARATUS AND METHOD FOR HANGING SHELVES

(76) Inventor: James Richard Wilson, Jr., 11407 NW. Kearney St., Portland, OR (US) 97229

( * ) Notice: Subject to any disclaimer, the term of this patent is extended or adjusted under 35 U.S.C. 154(b) by 317 days.

(21) Appl. No.: 10/856,244

(22) Filed: May 28, 2004

(65) Prior Publication Data

US 2005/0263467 A1 Dec. 1, 2005

(51) Int. Cl.
*A47F 5/08* (2006.01)

(52) U.S. Cl. ..... 211/113

(58) Field of Classification Search ..... 211/113, 211/118, 90.01, 186; 108/149
See application file for complete search history.

(56) References Cited

U.S. PATENT DOCUMENTS 1,566,551 A 12/1925 Ghrand
2,402,141 A * 6/1946 Holman et al. ..... 180/68.5
2,587,150 A 2/1952 Hansen et al.
4,061,092 A 12/1977 Jacobsen et al.
4,244,301 A * 1/1981 Nakatsu ..... 108/149
4,523,526 A * 6/1985 O'Neill ..... 108/149
4,844,265 A * 7/1989 Weeks, Jr. ..... 211/60.1
6,116,164 A 9/2000 Justen, Jr.
6,161,709 A 12/2000 Kluge et al.
6,286,691 B1 9/2001 Oberhaus et al.
6,311,626 B1 11/2001 Roberts
6,435,105 B1 8/2002 Mikich et al.
6,935,600 B1 * 8/2005 Barrepski ..... 248/317

* cited by examiner

*Primary Examiner*—Sarah Purol
(74) *Attorney, Agent, or Firm*—Birdwell & Janke, LLP

(57) ABSTRACT

An apparatus and a method for hanging shelves. An apparatus is provided for hanging one or more weight-bearing shelves from an overhead support member. The apparatus comprises a tube, a flexible member, an attachment member, and a cap. The tube has a bottom end with an opening, and is adapted to receive one or more of the shelves. The flexible member internally traverses substantially the length of the tube, and has a top end and a bottom end. The attachment member attaches the top end of the flexible member to the overhead support member. The cap has a flange portion and at least one aperture for receiving the bottom end of the flexible member therethrough. The flange portion is adapted for contacting the tube and transmitting the load of the weight-bearing shelves received by the tube to the flexible member. Shelves are attached to one or more of the tubes, preferably to four or more tubes. A method for hanging shelves using one or more of said apparatus is also provided.

25 Claims, 2 Drawing Sheets

APPARATUS AND METHOD FOR HANGING SHELVES

FIELD OF THE INVENTION

The present invention relates to an apparatus and a method for hanging shelves.

BACKGROUND

Shelving and systems for supporting shelves are used in many applications, such as warehousing and storage operations, manufacturing, retail stores, and home use such as in home workshops. Many shelving support systems are designed to rest on the floor, or to be attached to the walls. However, these methods of support have a number of disadvantages. Floor-supported shelf systems may mar the floor or require the modification of the floor surfaces to accommodate their placement. For example, shelf supports placed on wood floors may scratch the wood, whereas on carpet they may crush the carpet material. In some instances special mounting modifications may be needed to adequately support shelves needing a rigid footing on an otherwise relatively soft, carpeted surface. Similarly, wall-supported shelf systems may require wall surfaces to be modified, or the wall surface may be damaged by the shelves or their supports. For example, holes might need to be drilled to support shelf brackets, and wall finishes such as plaster can be damaged by contact with the shelf supports or the shelves themselves. Floor-supported shelves may have an undesirably large footprint, and the lower shelves may be largely invisible to people standing nearby. Some walls may not be strong enough to support the weight of cantilevered shelves and their contents, or it may be desired to locate the shelves away from any walls capable of bearing a weight load.

Supporting shelves from an overhead point of attachment has also been provided in the prior art, and this method of hanging shelves offers certain advantages. By suspending a shelf system from overhead, available floor area is expanded and ease of access may be enhanced. Visibility of the contents of the shelves is improved, as the shelves can be placed at convenient eye level without wasting space on shelves at lower positions that are harder to see without effort, and the placement of which may serve to hide items on the shelves from view or in shadow. Also, shelves mounted from an overhead point of attachment are much less likely to topple over than are shelf assemblies resting on the floor, possibly causing damage or injury, when the shelves are subjected to a lateral force such as in an earthquake or even from people leaning or pushing on the shelf assembly. Shelves mounted from overhead may even be safer than wall-mounted shelves in regards to seismic safety, as the weight is suspended from directly overhead so there is no leverage effect putting added stress on the point of attachment as is the case with wall mounting.

A number of approaches have been taken to providing systems for hanging shelves from overhead support structures such as ceiling joists. For example, U.S. Pat. No. 1,566,551 proposes a shelving support system comprising a crossbar with pendant hanging devices, one at each end of the crossbar, the pendant fastening devices having rests on which the shelf boards are supported, the crossbar being attached to an overhead support. However in this system the vertical positions of the various shelves are defined by where the rests are located on the pendant hanging devices and are not adjustable. Also, assembly of the unit is somewhat involved, and no provisions are made for tightening the structure when weight and wear have tended to loosen the fasteners.

U.S. Pat. No. 6,435,105 describes a suspended storage structure comprising wire shelves that are attached to a frame comprising drilled metal straps which are fastened together with nuts and bolts. While providing for a degree of adjustability, the system is rather unattractive constructed as it is of metal strapping that while perhaps suitable for a manufacturing environment would be inappropriate in an environment in which appearance is important.

Other systems have made use of flexible suspension members such as chains, which provide for suspending shelves without the need for retightening fasteners, since usage and the weight suspended tends to loosen them over time. U.S. Pat. No. 4,061,092 proposes using chains which are hung from an overhead support member to which shelf brackets are attached upon which the shelves rest. While relatively easy to install, this system again lacks aesthetic appeal in that the metal chains and shelf brackets are exposed to view, which is undesirable in an application where appearance is a factor. Also, use of chains provides no rigidity to the system, making it very prone to swinging motion in response to a lateral force.

U.S. Pat. No. 6,116,164 describes a suspended shelving apparatus wherein shelves can easily be repositioned, but the chains themselves are still visible, not adding to the visual appeal of the display. Again, shelves suspended from chains are highly prone to motion, swinging back and forth in response to a push on a shelf, due to the complete lack of rigidity of the chains.

Therefore, there is a need for supports and support systems for hanging shelving that can suspend one or more shelves from an overhead point of attachment, provides an attractive appearance with a finished look as would be suitable for shelving in any application where an attractive, finished appearance is desirable, and provides a support for shelves that is at least somewhat more rigid than chains are.

SUMMARY

The present invention provides an apparatus and method for hanging shelves. An apparatus is provided for hanging one or more weight-bearing shelves from an overhead support member. The apparatus comprises a tube, a flexible member, an attachment member, and a cap. The tube has a bottom end with an opening, and is adapted to receive one or more of the shelves. The flexible member internally traverses substantially the length of the tube, and has a top end and a bottom end. The attachment member attaches the top end of the flexible member to the overhead support member. The cap has a flange portion and at least one aperture for receiving the bottom end of the flexible member therethrough. The flange portion is adapted for contacting the tube and transmitting the load of the weight-bearing shelves received by the tube to the flexible member. Shelves are attached to one or more of the tubes, preferably to four or more tubes. A method for hanging shelves using one or more of said apparatus is also provided.

It is to be understood that this summary is provided as a means of generally determining what follows in the drawings and detailed description and is not intended to limit the scope thereof. Moreover, the objects, features and advantages of the preferred embodiments will be more readily understood upon consideration of the following detailed description taken in conjunction with the accompanying drawings.

DETAILED DESCRIPTION OF PREFERRED EMBODIMENTS

Figure 1:
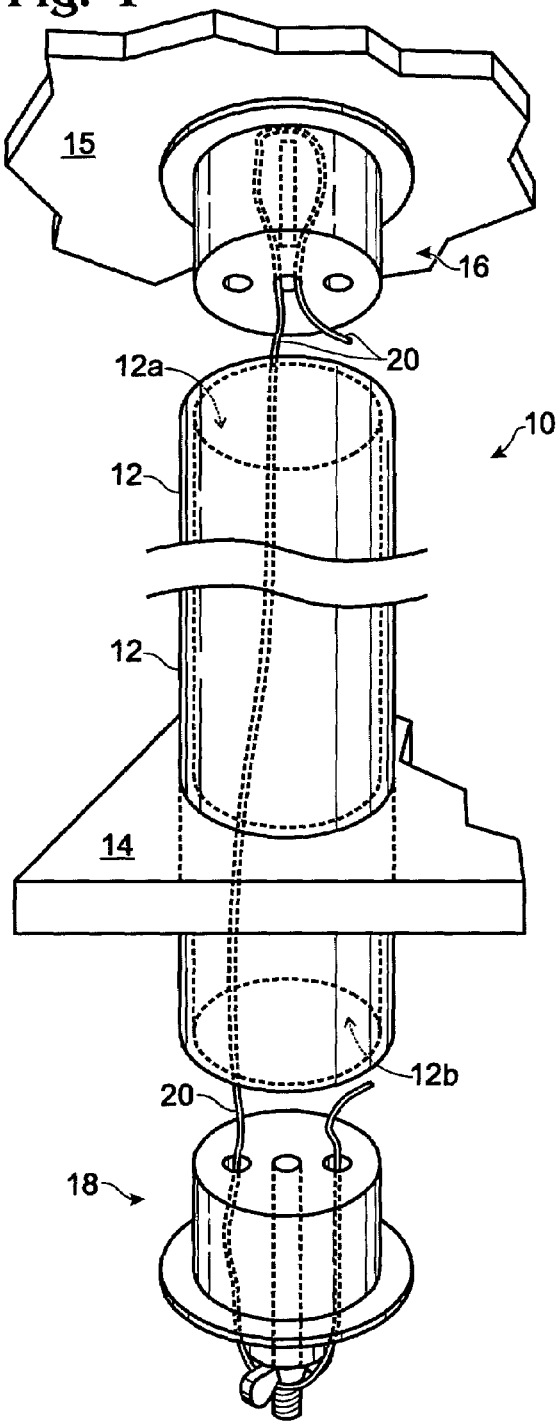
FIG. 1 shows a perspective of a preferred embodiment of a hanging shelf support unit according to the present invention.

FIG. 1 shows a preferred embodiment of a hanging shelf support unit 10 according to the present invention. An overview of the support unit is provided as follows. The support unit comprises a tube 12, a flexible member 20, and a cap 18 which is disposed at the bottom end of the tube. The bottom end of the flexible member is connected to the cap, and the top end of the flexible member is connected to an attachment member 16 which is in turn attached by a fastener 19 to an overhead support member 15. The flexible member internally traverses the tube. One or more shelves 14 are attached to the tube. The bottom end of the flexible member can preferably be tightened by drawing it through the cap such that the cap and the attachment member are drawn together against the resistance of the tube to provide a significant degree of rigidity.

Figure 4:
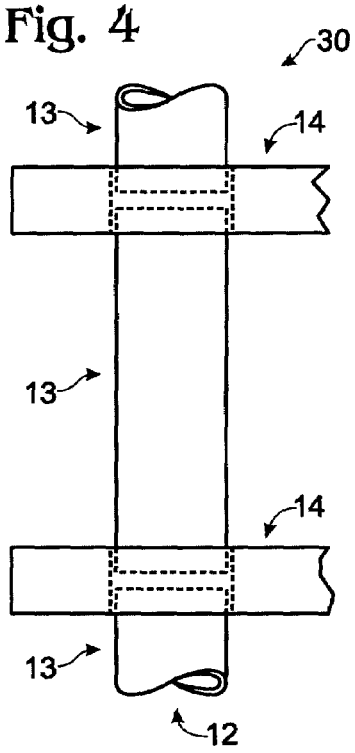
FIG. 4 shows an elevation of a plurality of shelves connected by tube sections.

An outstanding advantage according to the present invention is that the tube 12 may employ tube sections 13 that are standard in the art, such as the standard plastic tubing that is typically provided in plastic free-standing shelf systems, for example Keter® brand shelving. These sections are typically provided in lengths of about 16 inches and are cylindrical in shape. However, the tube 12 may be a non-standard or customized article, and may be formed of any suitable material such as for example, plastic, metal, or wood, in a wide variety of shapes and sizes. Typically, the tube has a constant diameter, a circular cross-section, and a constant wall thickness, but it may have other cross-sectional shapes and could vary in diameter and wall thickness without departing from the principles of the invention. The tube may and typically does comprise more than one tube section 13 connecting and supporting more than one shelf 14 (FIG. 4). The shelves, which are typically the standard plastic shelving that fits the standard plastic tubing mentioned above, are generally equipped with holes for receiving the tube sections 13, the longitudinally abutting adjacent tube sections thereby being joined together to form the tube 12, but other means of attaching the shelves to the tube may be used without departing from the principles of the present invention.

The flexible member 20 internally traverses substantially the entire length of the tube 12 from the top opening 12*a* to the bottom opening 12*b*. The flexible member provides support for the load of the shelving and must be strong enough to do so when the shelves are loaded to capacity. The flexible member may be a monofilament such as a wire or fiber, a polyfilament in braided or twisted form such as a cable or a rope, a chain, or any other sufficiently strong and flexible form. The flexible member may be made of plastic, metal, or any other material capable of possessing suitable strength and flexibility. The flexible member need not be flexible over its entire length, provided that its lower end is flexible where it is adapted to be secured to the cap 18.

The top end of the flexible member 20 is connected to the attachment member 16. The attachment member may be an integral part of the flexible member, such as a loop formed at the top end of a cable or wire, or it may be non-integral to the flexible member, the flexible member being attached to a separately provided piece. If the attachment member is integral to the flexible member, the flexible member is thus attached via the integral attachment member directly to the fastener 19, such as in the case of an attachment member comprising a loop formed at the top end of a cable or wire being attached to a fastener comprising a hook which is affixed to the overhead support member 15. If the attachment member is non-integral to the flexible member, the attachment member comprises a separate structure to which the flexible member is connected and which is in turn attached to the fastener 19. The overhead support member is understood in a collective sense, and may comprise one or more than one individual components such as beams, rafters, etc.

A preferred non-integral attachment member 16 comprises a plug 16*a*. The plug 16*a* fits the end of the tube 12. The plug may fit the inside of the tube, as is shown in FIG. 1 where the plug is adapted to fit inside the top end of the tube to a substantial extent such that the tube surrounds a well portion of the plug, or alternatively the plug may fit around the outside of the tube by means of a flange portion which substantially surrounds the top outer wall of the tube, a top flange. The fit of the plug to the tube provides for a significant degree of rigidity between the plug 16*a* and the tube 12, even when the fit is not a tight fit. However, a non-integral attachment member that does not fit the tube, such as a flat plate, could be used without departing for the principles of the present invention.

Figure 2:
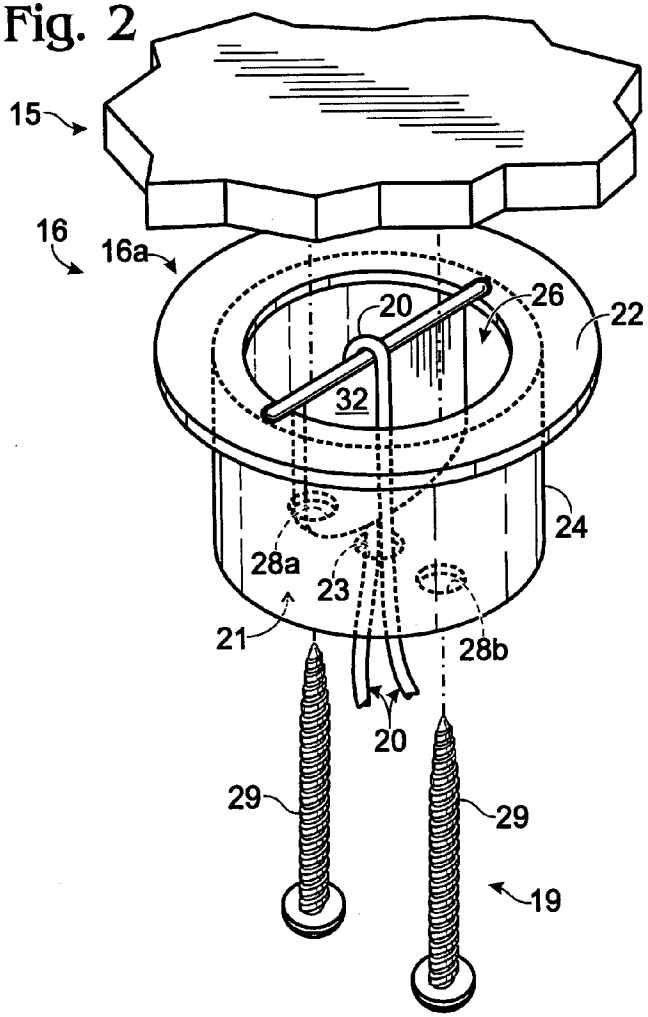
FIG. 2 shows a perspective of a top plug of a preferred embodiment.

The preferred plug, shown in FIG. 2, has a bottom face 21, a top face 22, and a wall 24. The wall 24 defines an internal space within the top plug between the faces 21 and 22. The plug is roughly circular in cross-section. The plug has at least one opening, such as an aperture 23 into the internal space within the plug, adapted to allow the flexible member to enter the plug to be secured internally.

The preferred plug 16*a* (FIG. 2) is adapted to internally secure the flexible member 20 by means of an aperture 23 in the bottom face 21, and a wedge member 32. The top end of the flexible member 20 passes from below through the aperture 23 into the interior of the plug, then a loop of the flexible member passes over the top of the wedge member and exits the interior of the plug again through the aperture. The weight load pulling downwardly on the flexible member is transmitted to the wedge member by the loop of the flexible member that passes over the wedge member. The resulting downwards pressure of the wedge exerts frictional force on the sections of the flexible member that the wedge contacts, the flexible member also contacting the edges of the aperture 23, which serves to secure the flexible member from slippage. However other features may also be used which serve to secure the flexible member to the plug without departing from the principles of the invention. The free end of the flexible member is preferably concealed within the tube when the support unit is assembled.

The preferred plug 16*a* is adapted to be attached to the overhead support member 15 by means of the fasteners 19 (FIG. 2). When the overhead support member is made of wood or another material which accepts screws, the fasteners are preferably screws 29, which pass upwards through two holes 28*a* and 28*b* in the bottom face 21 and through an opening 26 in the top face 22 of the plug and into the overhead support member. The plug is retained in position affixed to the overhead attachment member by the heads of the fasteners, such as by the screws 29 having heads larger than the holes 28*a* and 28*b*, or alternatively by the use of washers or other similar means. If the overhead support member is made of metal or other material which may be drilled to accept bolts and nuts, or drilled and tapped to accept bolts directly, the fasteners 19 are preferably bolts. It is understood that preferably more than one fastener is used, however this is not essential to the invention.

Figure 3:
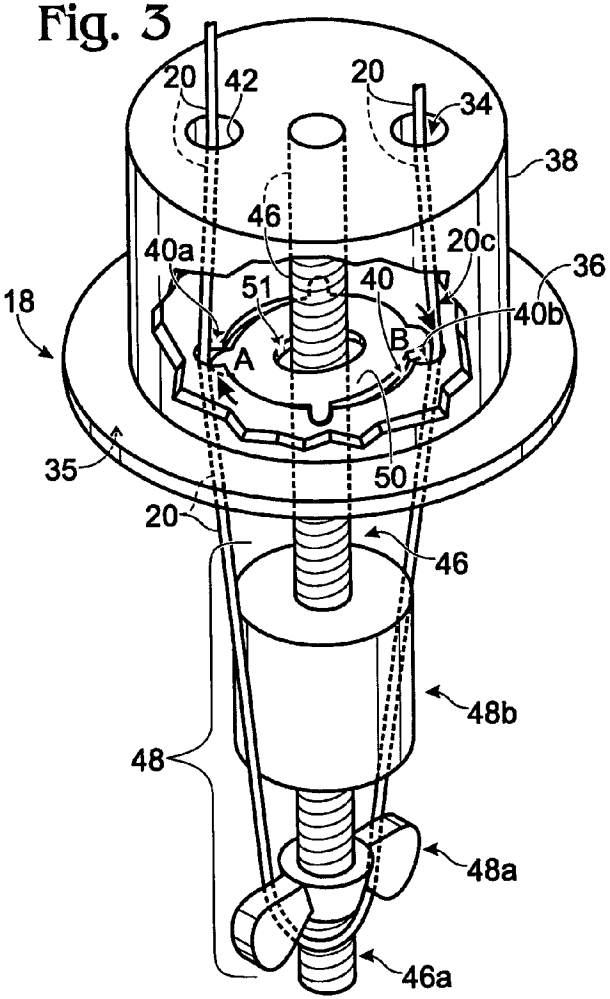
FIG. 3 shows a perspective of a bottom plug of a preferred embodiment.

The bottom end of the flexible member 20 is connected to the cap 18. The cap further comprises a flange member 36, which prevents slippage or translation of the tube 12 downwardly past the cap due to the diameter of the flange member being larger than the internal diameter of the tube 12. The cap may be of any cross-sectional shape, but it is typically circular in cross-section like the tube. The preferred cap, as is shown in FIG. 3, comprises a top face 34, a bottom face 35, and a wall 38 defining an internal space within the cap. A cable stopper is preferably disposed within the cap, comprising a top opening 42, a bottom opening 40, and a threaded rod 46 axially disposed within and secured to the cap and extending through the bottom opening beyond the bottom face. On the threaded rod, a pivot plate 50 with a central aperture 51 loosely fitting over the threaded rod is disposed such that the pivot plate may pivot from an angle of about 0 degrees with the bottom face to an angle of at least about 20 degrees. An edge of the pivot plate and a notch 40*a* of the bottom opening in the bottom face together form an aperture of variable diameter through which the flexible member passes. A nut 48*a* is disposed on the threaded rod below the pivot plate. Tightening the nut applies pressure to the pivot plate to force the pivot plate into forming a smaller angle with the bottom face, such that point "B" (FIG. 3) moves downwardly and point "A" moves upwardly. As the pivot plate pivots, it forms an increasingly smaller angle with the bottom face, thereby decreasing the size of the aperture, constricting the flexible member. By modifying the amount of torque with which the nut is tightened down, a varying amount of frictional force may be applied to the flexible member such that no significant slippage occurs when the support unit 10 is under a weight load, but the flexible member is not damaged by excessive constriction by the aperture of variable diameter.

Preferably, a nut and bushing assembly 48 is disposed on the threaded rod, a bushing 48*b* being loosely disposed on the threaded rod such that it may slide freely over the threads, while the nut 48*a* is threaded onto the threaded rod such that the bushing is situated between the nut and the pivot plate on the threaded rod. The nut is preferably a wing nut or other similar feature that may be hand-tightened, but tool-tightened nuts may be used without departing from the principles of the present invention. Tightening down the nut applies pressure to the proximal face of the bushing, which in turn applies pressure to the pivot plate, causing it to form the increasingly smaller angle relative to the bottom face of the cap. Once the flexible member is secured by frictional force through tightening down the nut, the remaining free end 20*c* of the flexible member may preferably be looped back into the cap through a second bottom notch 40*b*. Preferably the threaded rod, the end of the flexible member, and the nut and bushing assembly are all concealed from view by further threading a decorative cap (not shown) onto the end 46*a* of the threaded rod.

In the shelf and support assembly 30 (FIG. 4), the shelves 14 are preferably affixed to the tube 12, which comprises the tube sections 13, by a slight interference fit in a sleeve in the shelves, but any of a number of means well known in the art, such as flanges, screws, adhesives, etc. may be used without departing from the principles of the invention. The shelves are adapted to bear the weight suitable for the purpose. The shelves are preferably formed of plastic, but may be formed of any suitable material such as metal, plastic, wood, glass, etc. The shelves are preferably rectangular in form but they may have a wide variety of shapes, being rectangular, circular, elliptical, polygonal, etc. without departing from the principles of the invention. The shelves 14 are preferably substantially flat, but they may be curved, taking the form of shallow bowls or troughs, or they may have rims, dividers, compartments, etc. without departing from the principles of the present invention.

The assembled support unit 10 supports one or more shelves 14 preferably by the use of at least four support units being placed at each of the four corners of rectangular shelves, but other arrangements are possible without deviating from the principles of the present invention. The support units can support shelves at their corners, along edges, or even from a centrally located position in the shelf. The shelves are typically affixed so they cannot move rotationally around the support unit, but alternatively the shelves may be adapted to rotate around the support unit as when a single support unit supports a stack of shelves by attachment in the middle of each shelf as in a "lazy Susan," in which case the shelves are preferably adapted with bearings such that the shelves may rotate freely around the single support unit.

It is understood that while support unit 10 is preferably adapted for hanging shelves, other items can equally well be hung, including light fixtures, ducting, or any similar item desired to be supported from an overhead point of attachment. Even very heavy objects could be supported using this apparatus provided that the components of the support unit are adapted to bear the necessary weight.

While it is preferred that the support unit 10 be substantially vertical when in its installed position, other orientations may be used without departing from the principles of the present invention. For example, support units may be angled away from the vertical, or could even be mounted in a reverse orientation affixed to the floor such that the cap and the attachment member are reversed in position.

Thus, the present invention provides an apparatus, a hanging shelf support unit, whereby one or more shelves may be supported from an overhead point of attachment, which is readily assembled, provides an attractive appearance with a finished look, and provides a relatively rigid support to diminish motion of the shelves when acted on by a lateral force.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. An apparatus for hanging one or more weight-bearing shelves from an overhead support member, comprising:

a tube having a bottom end with an opening and adapted to receive the one or more shelves;

a flexible member for internally traversing substantially the length of said tube, said flexible member having a top end and a bottom end;

an attachment member for attaching said top end of said flexible member to the overhead support member; and a cap adapted for connecting said flexible member thereto, and having a flange portion adapted for contacting said tube and transmitting the load of the weight-bearing shelves received by said tube to the flexible member.

2. The apparatus of claim 1, wherein said flexible member comprises a metal cable.

3. The apparatus of claim 1, wherein said tube is formed of plastic.

4. The apparatus of claim 1, wherein said tube has a top opening, and wherein said attachment member comprises a plug adapted to fit said top opening of said tube, said plug and said tube fitting one inside the other.

5. The apparatus of claim 4, wherein said plug includes an aperture for receiving the top end of said flexible member therethrough, and a wedge member adapted for wedging said flexible member in said aperture.

6. The apparatus of claim 5, wherein said cap includes an aperture of variable size for constricting said flexible member.

7. The apparatus of claim 6, wherein said cap includes a plate adapted to pivot about said aperture for varying the size of said aperture.

8. The apparatus of claim 1, wherein said cap includes an aperture of variable size for constricting said flexible member.

9. The apparatus of claim 8, wherein said cap includes a plate adapted to pivot about said aperture for varying the size of said aperture.

10. The apparatus of claim 8, further comprising a second aperture in said cap for receiving a distal-most end of said flexible member therethrough.

11. An apparatus for supporting a weight from an overhead support member, comprising:

one or more shelves for bearing the weight;

a tube having a bottom end with an opening and adapted to receive said one or more shelves;

a flexible member for internally traversing substantially the length of said tube, said flexible member having a top end and a bottom end;

an attachment member for attaching said top end of said flexible member to the overhead support member; and a cap adapted for connecting said flexible member thereto, and having a flange portion adapted for contacting said tube and transmitting the load of the weight-bearing shelves received by said tube to the flexible member.

12. The apparatus of claim 11, wherein said shelves are affixed to said tube.

13. A shelf assembly comprising one or more of the apparatus of claim 12 attached to the overhead support member.

14. A method for hanging one or more shelves from an overhead support member, comprising:

providing a tube having a bottom end with an opening, a flexible member having a top end and a bottom end, an attachment member for attaching said top end of said flexible member to the overhead support member, and a cap adapted for connecting the bottom end of said flexible member thereto and having a flange portion;

attaching said flexible member to the overhead support member by use of said attachment member;

disposing said flexible member inside the tube so as to traverse substantially the length thereof;

connecting the bottom end of said flexible member to said cap;

disposing said cap at said bottom end of said tube; and connecting the one or more shelves to said tube, said flange portion of said cap contacting said tube and transmitting the load of the weight-bearing shelves received by said tube to the flexible member.

15. The method of claim 14, wherein the top end of said flexible member is secured to said attachment member by passing the flexible member through an aperture in said attachment member and wedging said flexible member in said aperture.

16. The method of claim 15, where said step of connecting the bottom end of said flexible member to said cap comprises inserting the bottom end of said flexible member through a first aperture in said cap.

17. The method of claim 16, further comprising varying the size of said first aperture in said cap thereby constricting said flexible member inserted therethrough.

18. The method of claim 17, further comprising pivoting a plate about said first aperture in said cap to vary the size of said first aperture.

19. The method of claim 16, wherein said cap includes a second aperture, wherein said step of connecting further comprises looping said bottom end of said flexible member through said second aperture of said cap.

20. The method of claim 19, wherein said step of looping results in a distal-most end of said bottom end of said flexible member being retained inside said tube.

21. The method of claim 14, where said step of connecting the bottom end of said flexible member to said cap comprises inserting the bottom end of said flexible member through a first aperture in said cap.

22. The method of claim 21, further comprising varying the size of said first aperture in said cap thereby constricting said flexible member inserted therethrough.

23. The method of claim 22, further comprising pivoting a plate about said first aperture in said cap to vary the size of said first aperture.

24. The method of claim 21 wherein said cap includes a second aperture, wherein said step of connecting further comprises looping said bottom end of said flexible member through said second aperture of said cap.

25. The method of claim 24, wherein said step of looping results in a distal-most end of said bottom end of said flexible member being retained inside said tube.

* * * * *